United States Patent [19]

Sullivan et al.

[11] 4,338,085

[45] Jul. 6, 1982

[54] APPARATUS FOR MANUFACTURING ENVELOPES

[75] Inventors: John Sullivan, San Jose; Harold R. Lillibridge, Burlingame, both of Calif.

[73] Assignee: Champion International Corporation, Stamford, Conn.

[21] Appl. No.: 136,493

[22] Filed: Apr. 3, 1980

[51] Int. Cl.[3] ..... B31B 21/26

[52] U.S. Cl. ..... 493/254; 493/241; 493/245; 493/266

[58] Field of Search ..... 493/254, 245, 266, 417, 493/435, 443, 241

[56] References Cited

U.S. PATENT DOCUMENTS

| | | | |
|---|---|---|---|
| 2,058,501 | 10/1936 | Potdevin | 493/254 X |
| 2,645,166 | 7/1953 | Blizard | 493/266 X |
| 3,166,996 | 1/1965 | Sauerman | 493/254 X |
| 3,438,310 | 4/1969 | Woodruff et al. | 493/254 X |
| 3,712,185 | 1/1973 | Falasconi et al. | 493/266 X |
| 3,908,524 | 9/1975 | Shore | 493/254 X |
| 4,016,808 | 4/1977 | Young | 493/254 |
| 4,225,128 | 9/1980 | Holyoke | 493/442 X |

*Primary Examiner*—James F. Coan

*Attorney, Agent, or Firm*—Evelyn M. Sommer

[57] ABSTRACT

Apparatus for feeding, scoring, gumming, and folding a blank into an envelope.

20 Claims, 19 Drawing Figures

GUMMING STATION 34
32
140
142
146
136
134
132
288
296
298
306
310
312
318
320
322
324
326
328
330
332
334
338
344
346
348
370
372
374
376

ALIGNING STATION

SIDE SCORING STATION

BACK SCORING STATION

APPARATUS FOR MANUFACTURING ENVELOPES

BACKGROUND AND SUMMARY OF THE INVENTION

This invention relates to apparatus for manufacturing envelopes, and more particularly, apparatus for forming an envelope used to receive and store a floppy disc.

Floppy discs are used in computer applications, such as word processing equipment, to store and record bits of information which can be retrieved by reinserting the disc into the equipment. When not in use, the disc is received and stored in a generally rectangular envelope conforming in the area and size to the outer dimensions of the disc. The envelope is provided with an upwardly extending flap portion to serve as a tab for receiving filing information or indicia to identify the disc when stored. This invention relates to an apparatus for manufacturing such envelopes from pre-shaped blanks.

In accordance with the invention, an ungummed blank is fed into the apparatus and spaced from a preceding and suceeding blank by contact with vertical alignment pins mounted on endless chains associated with and running parallel to a pair of endless feed belts. The belts have an upper run driven at a speed greater than the chains so that each blank is moved into abutment with a pin on each chain to space the blanks fed into the apparatus. The pins also serve to align the side edges of each blank with a plurality of side and back scoring rollers at a first and second scoring station, and successive, first folding, gumming, and second folding, stations.

The side scoring rollers score the blank along parallel lines spaced inwardly from the opposed longitudinal edges of the blank. A single back scoring roller scores the blank along a single lateral line extending between the tops of the side parallel score lines intermediate the top and bottom edges of the blank.

The blank is then folded about its back score line by advancing the leading or top edge of the blank into contact with a counterclockwise rotating roller while feeding the blank in a linear, forward direction about an idler roller. The counterclockwise rotating roller pulls the blank forwardly through the nip of the idler roller and counterclockwise rotating roller in folded condition about the back score line, forming a "bucklefold", wherein the blank is folded substantially in half about itself.

Gum or adhesive is then applied to the previously ungummed blank along the longitudinal edges of the upper or folded half of the folded blank. Continued forward feed of the folded blank causes the opposite longitudinal edges of the unfolded or lower half of the blank to contact a folder disposed in the path of movement which bends each longitudinal edge of the unfolded lower half of the blank, 180 degrees about the adjacent side score line, onto the gummed portions of the upper or folded half of the blank. The lower half of the blank is thus adhesively connected to the upper half to form a rectangular envelope enclosure for receiving and storing a floppy disc. The finished envelope is then delivered to a table, stacked and boxed.

The back score is placed so that when the blank is folded back upon itself, the leading (top) edge of the blank overlaps the trailing (bottom) edge to form a tab flap for the envelope.

BRIEF DESCRIPTION OF THE DRAWINGS

Further object and advantages of the invention will become apparent from the following description and claims, and from the accompanying drawings, wherein:

DETAILED DESCRIPTION OF THE PREFERRED EMBODIMENT

Figure 1A:
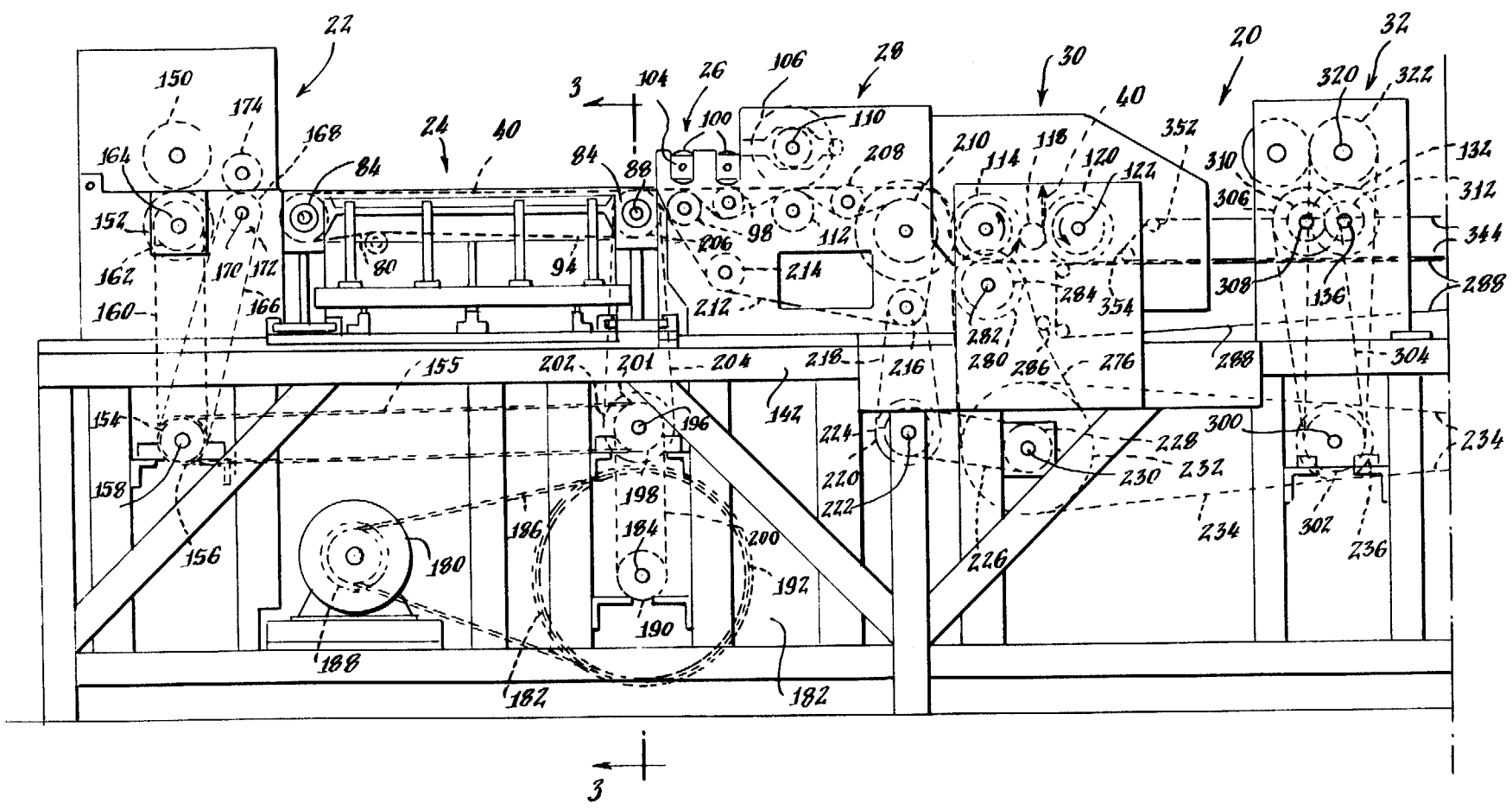
FIG. 1A is a side view in elevation of the forward section of the envelope manufacturing apparatus of the present invention.
Figure 1B:
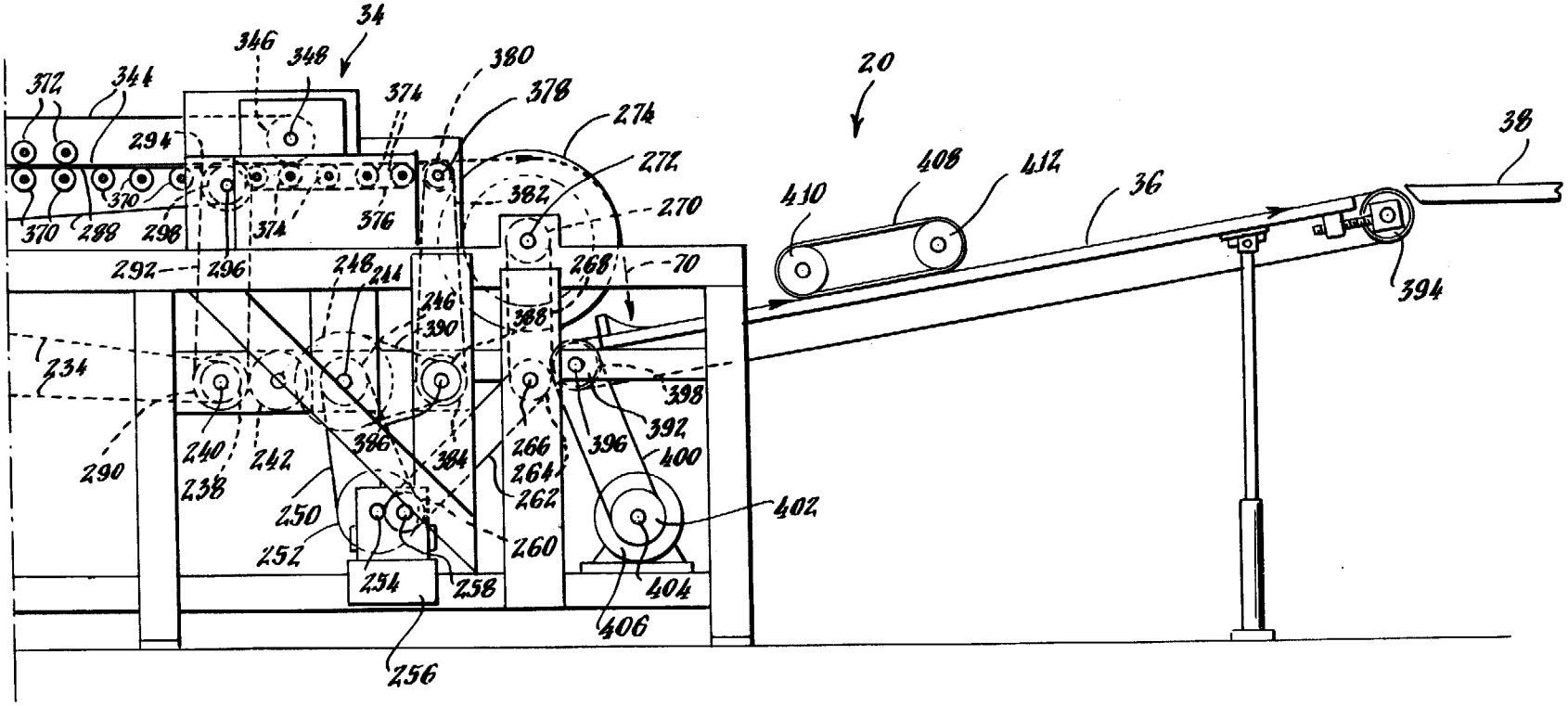
FIG. 1B is a continuation of FIG. 1A and comprises a side view in elevation of the rear section of the envelope manufacturing apparatus of the present invention.
Figure 2:
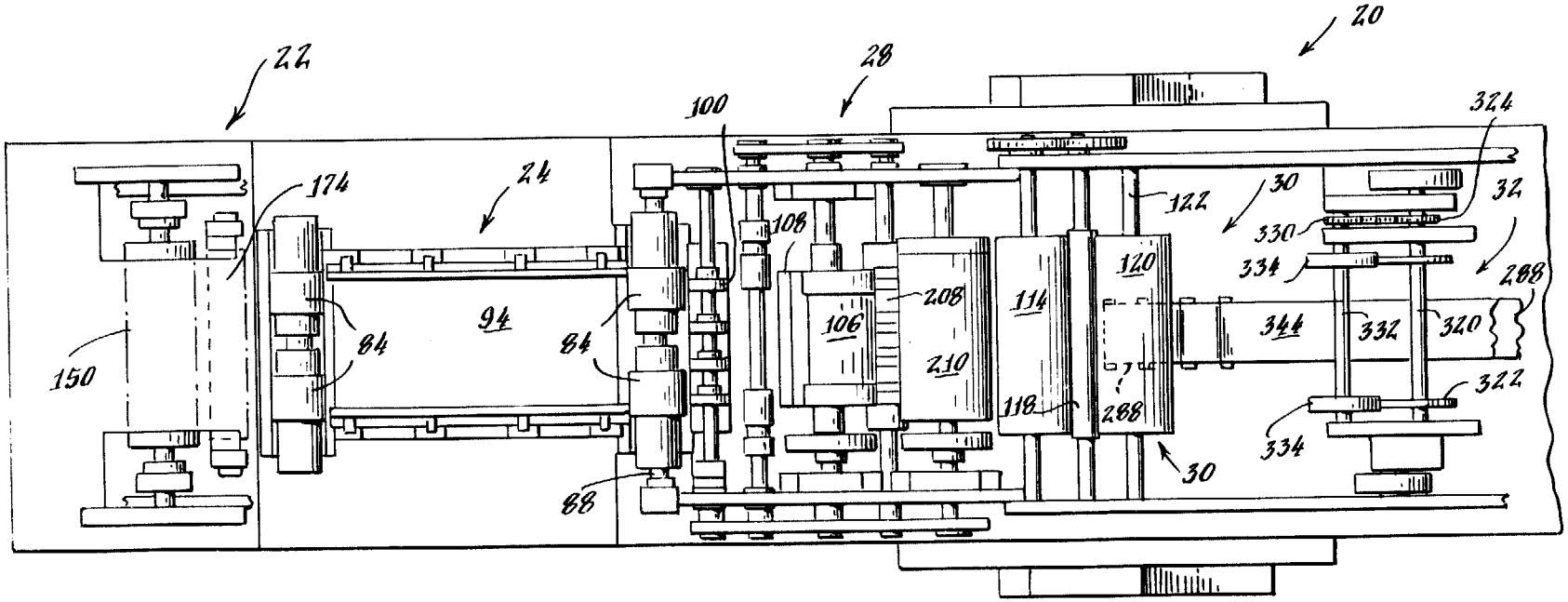
FIG. 2 is a top plan view of the apparatus illustrated in FIG. 1A.
Figure 3:
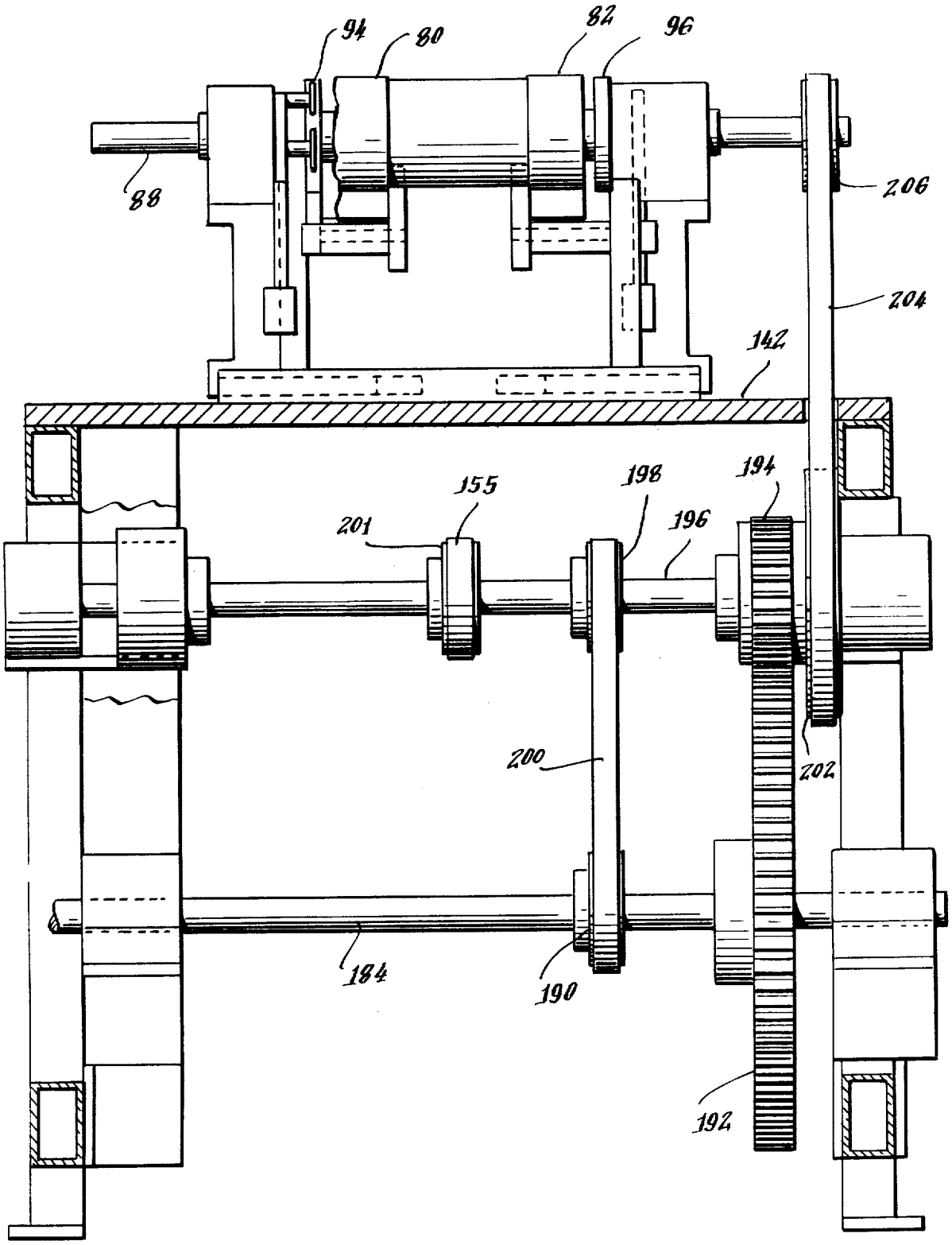
FIG. 3 is a cross-sectional view taken substantially along the plane indicated by line 3—3 of FIG. 1A.

Referring now to the drawings in detail, wherein like numerals indicate like elements throughout the several views, the envelope manufacturing apparatus of the present invention is illustrated in FIGS. 1A and 1B by the numeral 20. The apparatus 20 includes a number of envelope blank processing stations.

As illustrated in FIGS. 1A and 1B, an envelope blank is fed into the apparatus at station 22, aligned by the apparatus at station 24 with the remaining processing stations in the apparatus and spaced from a preceding and succeeding blank. The blank is fed from the alignment station 24 to a first scoring station 26 wherein a pair of side scores parallel to but spaced inwardly from the edges of the blank are formed. A second scoring station 28 imparts a lateral score to the blank at approximately its mid-point extending from one longitudinal edge to the other. The blank then enters a first folding station 30 wherein a "buckle-fold" is imparted to the blank to fold it back upon itself about the lateral fold formed at the back scoring station 28.

The opposite lateral edges of the folded upper half of the blank have adhesive or gum applied at a gumming station 32. The lower side edges of the envelope blank are then folded 180 degrees about an adjacent side score line so as to overly the gummed portions of the upper half of the blank and are adhesively connected thereto at a second folding station 34.

The completed envelope 70 is then dropped onto a delivery conveyor 36 and delivered to a table 38 wherein the envelopes 70 are stacked and packaged for shipment.

Figure 6:
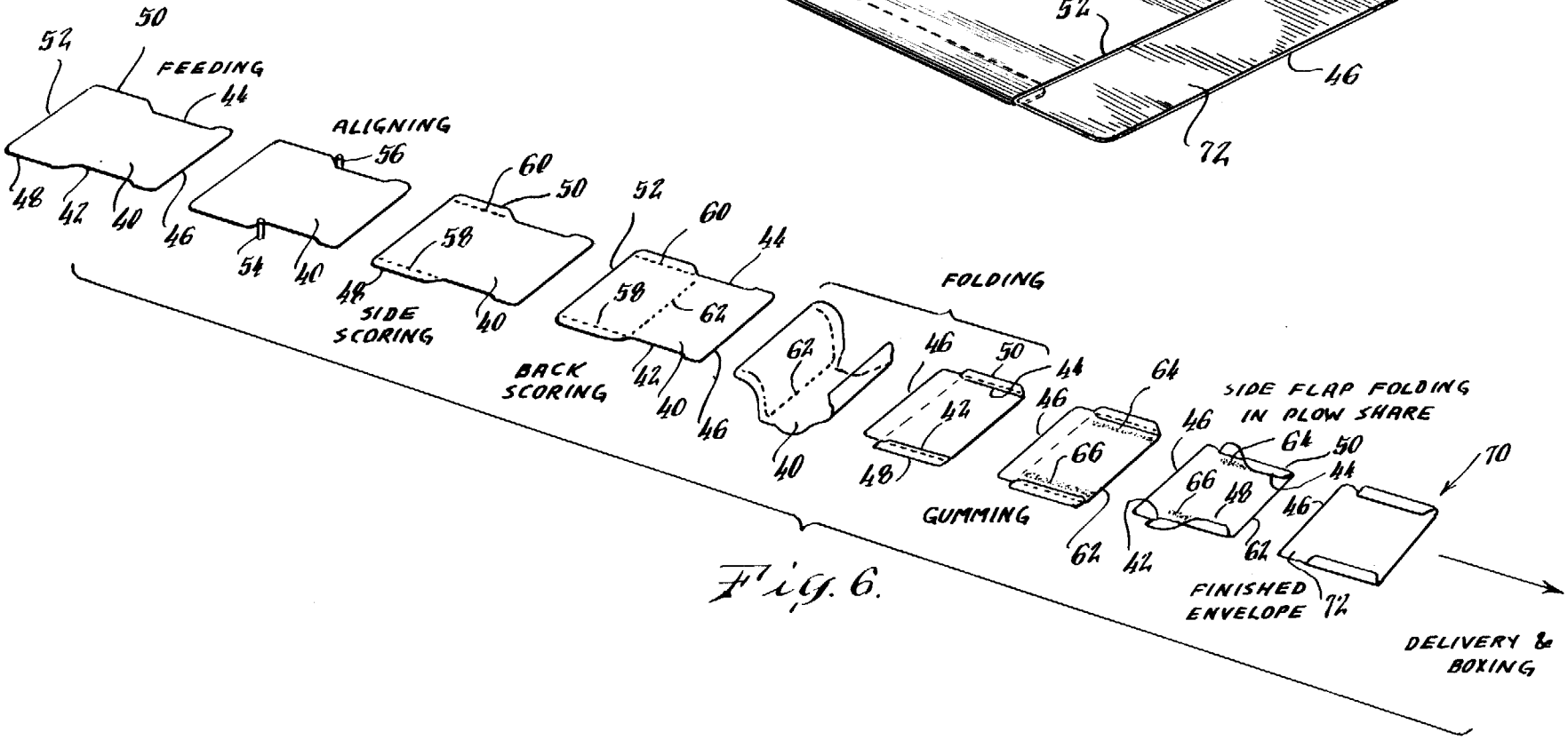
FIG. 6 is a schematic diagram illustrating the successive functions performed by the apparatus of the present invention on an envelope blank.

FIG. 6 illustrates the sequence of operations performed on the envelope blank 40 by the various processing stations 22-34, inclusive.

Figure 8:
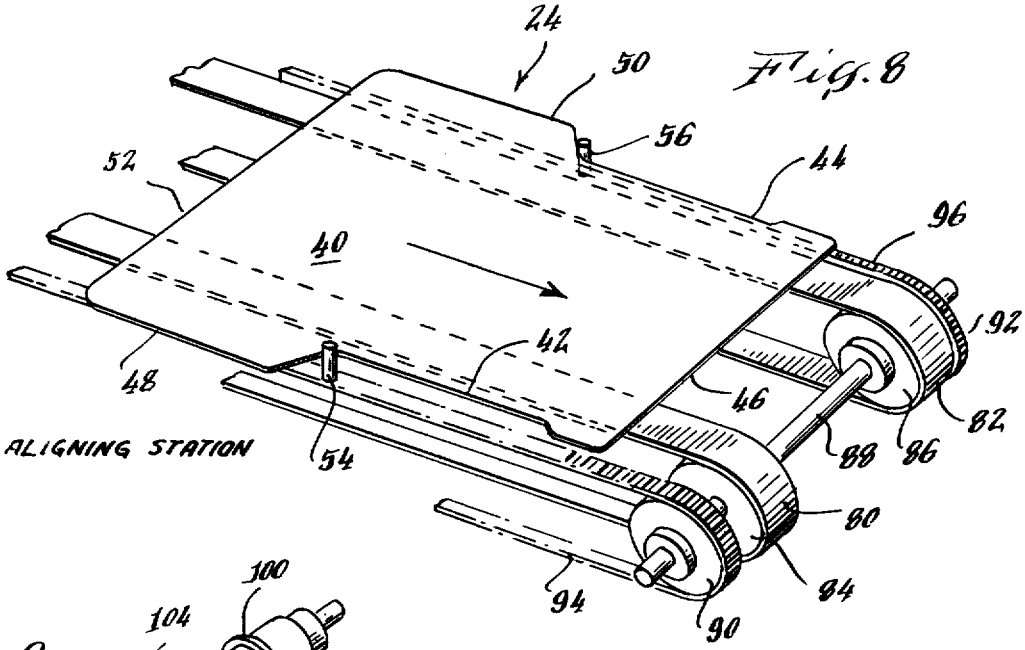
FIG. 8 is a schematic perspective view illustrating the operation of the alignment station in the envelope manufacturing apparatus of the present invention.

As illustrated in FIG. 6, the blank 40 is planar and substantially rectangular except for a pair of indented side edges 42 and 44 extending towards the leading edge 46 of blank 40 and extending along the top half of the blank. The remainder of the blank 40 includes a second pair of parallel longitudinal edges 48 and 50 which terminate at the trailing edge 52. The blank 40 is fed at station 22 to an alignment station 24 wherein it abuts a pair of spaced pins 54 and 56 at the neck edges formed between the indented longitudinal edge 42 and edge 48 and indented longitudinal edge 44 and edge 50. The pins are provided on spaced alignment chains 90, 92, (see FIG. 8), which preclude excess forward movement of the blank 40 so that it is spaced from a succeeding and preceding blank. The pins 54 and 56 also align the blank 40 with the remainder of the processing stations.

At the first score station 26 a pair of parallel score lines 58 and 60 are imprinted on blank 40 adjacent to but between edges 48 and 50. At the second score station 28, a lateral score line 62 extending between indented edges 42 and 44 is formed substantially dividing the blank 40 in half between its leading and trailing edges 46 and 52, respectively.

At the first folding station 30, the blank 40 is "buckle-folded" substantially in half about lateral score line 62. The areas 64 and 66 adjacent the edges 42 and 44, respectively, on the upper half of the folded blank 40 have gum or adhesive applied in a longitudinal strip at gum station 82. Finally, the lower portions of the blank 40 between edges 42, 48 and 44, 50, are folded at the second folding station 34, 180 degrees so as to overly the gummed areas 66, 64, respectively, and are adhesively connected to the folded upper half of the blank to form the envelope 70 for receiving and storing a floppy disc.

The back score 62 is placed so that when the blank 40 is folded back upon itself, the leading edge 46 of the blank 40 overlaps the trailing edge 52 to form a closure flap 72 for the envelope 70. The finished envelope 70 is then dropped onto delivery conveyor 36 and delivered to table 38.

FIGS. 8 to 17, inclusive, illustrate in schematic form the apparatus for carrying out the operational sequence on blank 40 at the various stations 22-34, inclusive.

Blank 40 is fed to the alignment station 24 and is positioned on a pair of endless belts 80 and 82. Belts 80 and 82 are entrained about pulley pairs 84 and 86, respectively, at opposite ends thereof. A pulley 84 and a pulley 86 are mounted on a common shaft 88 which, as described hereinafter, is a driven shaft. Also mounted on shaft 88 adjacent each pulley 84, 86,respectively, is a sprocket 90, 92 respectively. Sprockets 90 and 92 are in meshing engagement with an endless chain 94 and 96, respectively, running parallel to an adjacent belts 80 and 82, respectively. Upright, spaced pins 54 are mounted along chain 94. Upright spaced pins 56 are mounted along endless chain 96.

Belts 82 and 84 have an upper run for supporting blank 40 and are driven at a speed greater than the chains 92 and 94. Accordingly, each blank 40 is moved into abutment with a pair of pins 54, 56 along the opposite necked down portions of the blank between edges 42, 48 and 44, 50. The pins 54 and 56 space the blank 40 from a preceding and succeeding blank and also serve to align the side edges of the blank with a plurality of side and back scoring rollers 100 and 106, respectively, at stations 26 and 28, respectively, and successive first folding, gumming, and second folding stations 30, 32 and 34, respectively.

Figure 9:
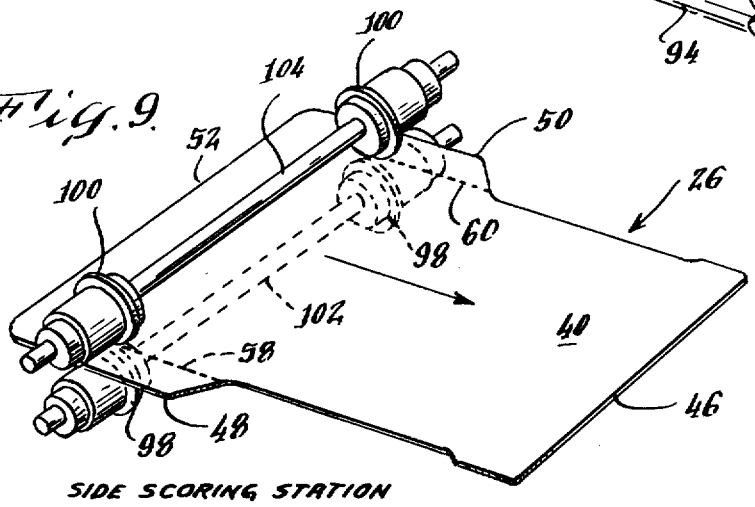
FIG. 9 is a schematic perspective view illustrating the operation of the side scoring station in the apparatus of the present invention.
Figure 10:
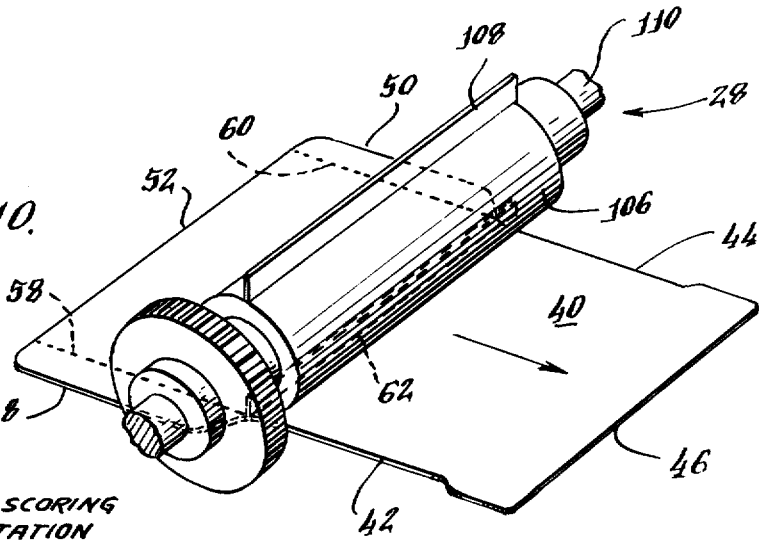
FIG. 10 is a schematic perspective view illustrating the operation of the back scoring station in the apparatus of the present invention.

As indicated in FIG. 9, the blank 40 is fed from the alignment station 24 between pairs of impression type side scoring rollers 98 and 100 adjacent the opposite longitudinal edges 48 and 50 of blank 40. Rollers 98 and 100 are mounted below and above the path of travel of blank 40 on shafts 102 and 104, respectively. As the blank 40 passes between the pairs of rollers 98, 100 adjacent to each edge 48, 50 of blank 40, the score line 58 and 60 is imprinted in the blank parallel to and adjacent the edges 48 and 50, respectively.

From the side scoring station 26, the blank is fed to the back scoring station 28. The back scoring station 28 includes a single back scoring roller 106 having a radially extending fin 108 for forming an impression 62 laterally across the blank 40 between the indented side edges 42, 44 substantially at the mid-section of blank 40. Roller 106 is rotated by shaft 110. Fin 108 makes an impression in blank 40 against a rubber roll 112 (FIG. 1A) disposed beneath the path of travel of blank 40 in alignment with roll 106.

Figure 11:
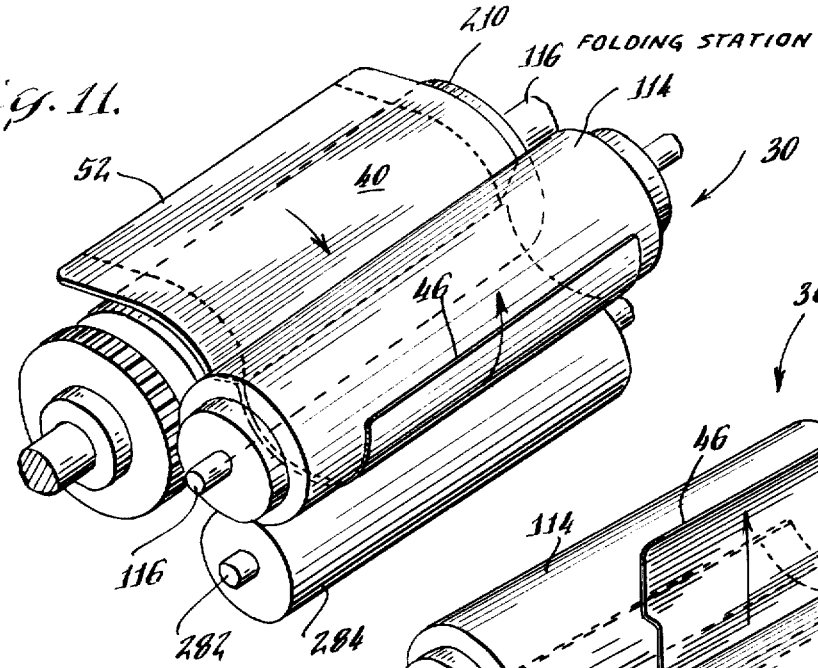
FIGS. 11 and 12 are schematic perspective views illustrating successive steps in the operation of the first folding station in the apparatus of the present invention.
Figure 12:
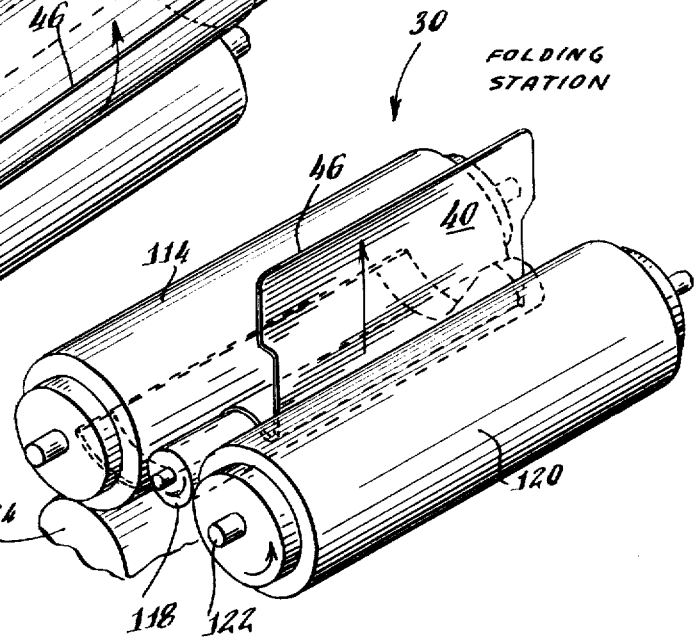
Figure 13:
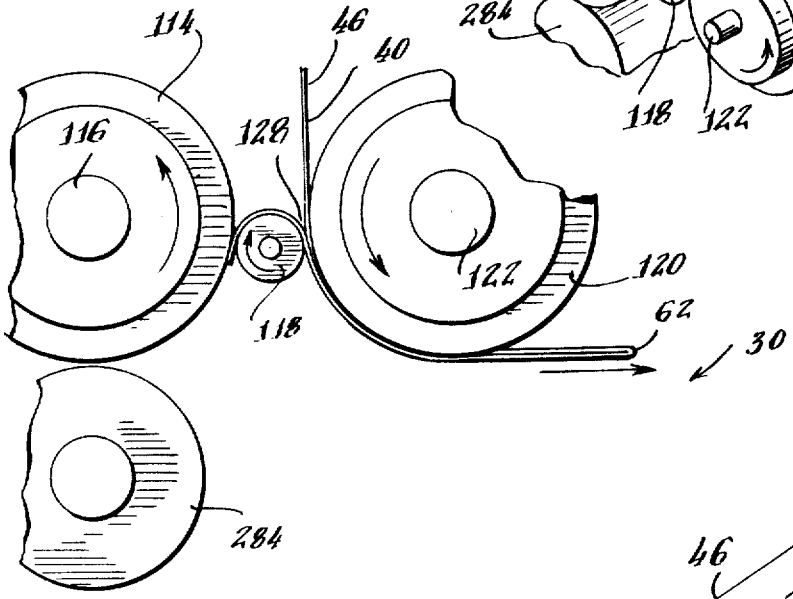
FIG. 13 is a schematic side view in elevation of the first folding station of FIGS. 11 and 12, illustrating the manner of completing the folding of the blank initiated in FIGS. 11 and 12.

Next, as illustrated in FIGS. 11-13, the blank 40 is folded about the lateral score line 62 imprinted in blank 40 by fin 108 on roller 106 at station 28. At the folding station 30, a roller 114 is mounted on a shaft 116 for rotation in a counterclockwise direction as viewed in FIGS. 11-13. Blank 40 is fed over a driven roller 210 and under a roller 114 which in turn, feeds blank 40 over a smaller idler roller 118 disposed between roller 114 and a counterclockwise rotating roller 120 mounted on a shaft 122.

Figure 14:
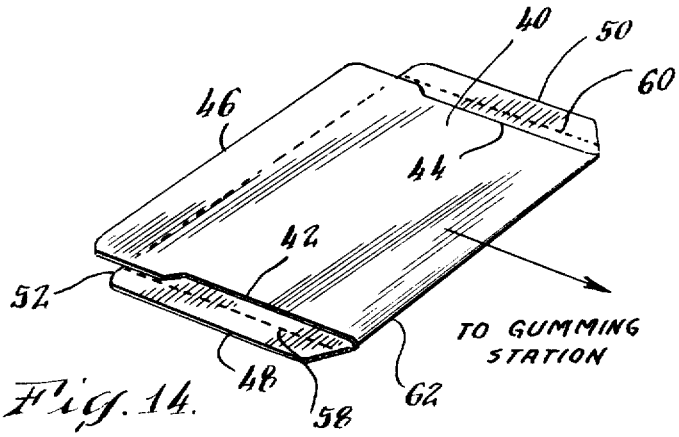
FIG. 14 is a perspective view of the envelope blank after it leaves the first folding station of FIGS. 11 to 13.

The blank is fed by roller 114 about the exterior of idler roller 118 until it abuts roller 120. Abutment of the leading edge 46 of blank 40 with roller 120 while roller 114 feeds the same forwardly, causes the blank to bend and move vertically upwardly as illustrated in FIG. 12. When the back score line 62 on blank 40 reaches the nip of rollers 118 and 120 the counterclockwise rotation of roller 120, as viewed in FIGS. 11-13, catches the score line in the nip and pulls the blank 40 forwardly through the nip 128 in folded condition about the back score line 62, forming a "buckle-fold" wherein the blank 40 is folded substantially in half about itself, as illustrated in FIG. 14.

As the leading edge 46 of blank 40 is thrust upwardly as illustrated in FIG. 12, an index tab (not shown) may be punched by conventional apparatus on the edge 46 by removing all but a rectangular square of material from the edge. The tab may be ultimately inscribed with suitable indicia to identify the disc to be stored within the finished envelope. As illustrated in FIG. 14, the leading edge 46 of the blank overlaps the trailing edge 52 which forms the basis for the index tab for the finished envelope 70. The leading edge 46 now becomes the trailing edge of the blank 40 as it is fed forwardly about roller 120 to the gum applying station 32, schematically illustrated in FIG. 15.

At the gumming station 32, gum or adhesive 130 is applied adjacent to the edges 42 and 44 of the folded-over upper half of blank 40 by spaced gumming dies 132 and 134 connected by a common shaft 136.

Figure 16:
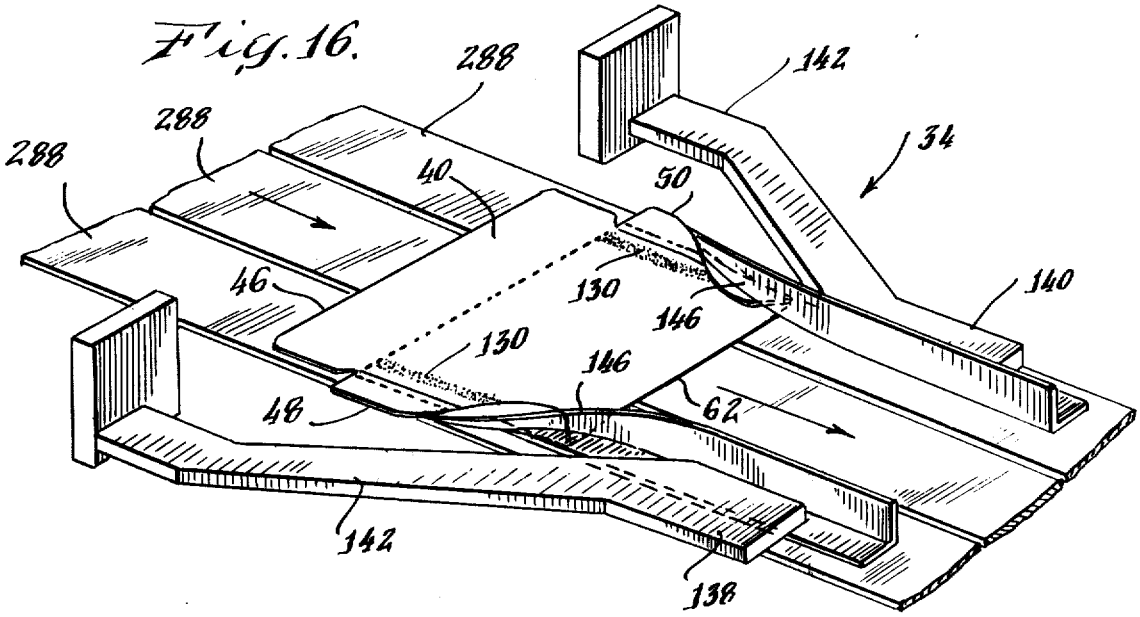
FIG. 16 is a schematic perspective view illustrating the operation of the second folding station in the apparatus of the present invention.
Figure 17:
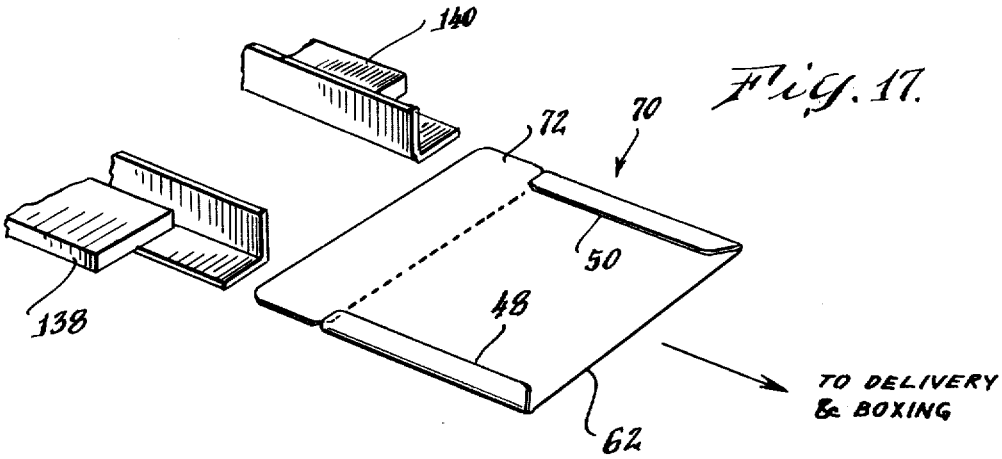
FIG. 17 is a schematic perspective view of the finished floppy disc envelope leaving the second folding station of FIG. 16 preparatory to stacking and boxing.

As illustrated in FIG. 16 and 17, continued forward feed of the folded blank 40 causes the blank to enter a second folding station 34 wherein the opposite longitudinal edges 48 and 50 of the unfolded lower half of blank 40 contact a folder 138 and 140, respectively, disposed in the path of movement of blank 40. Each folder 138 and 140 is connected to the framework 142 of the apparatus 20 and includes a curved or arcuate surface running the length thereof which coverge towards the center of the path of movement of the blank 40, and contacts one of the edges 48 or 50. Contact of the edges 48 and 50 with the interior of the folders 138 and 140 disposed in the path of movement of the blank 40 bends each edge 48, 50, onto the adjacent gummed area 130 to overly the folded upper half of the blank so as to be adhesively connected thereto as illustrated in FIG. 17, to form a rectangular envelope enclosure 70 for receiving and storing a floppy disc. Finished envelope 70 is then delivered to conveyor 36 which brings it to table 38 for stacking and boxing.

FIGS. 1 to 5 illustrate the overall combination of operational components of the envelope manufacturing apparatus 20. The path of blank 40 as it moves through the apparatus 20 is indicated by the arrows in FIGS. 1A and 1B.

The envelope blank 40 is placed in the apparatus 20 at the feed station 22 between a pair of contacting rollers 150 and 152. Roller 152 is driven by an electric motor 180 connected as described hereinafter to a double sheave pulley 154 mounted on a shaft 158. A belt 160 is entrained about one of the sheaves of pulley 154 and about a second pulley 162 connected to a shaft 164 fixed to roller 152. A second pulley 156 is mounted on shaft 158 and drives an endless belt 166 which is entrained at its upper end about a pulley 168 connected to a shaft 170. Mounted on shaft 170 is a second roller 172 which is in tangential contact with an upper roller 174. The driven roller pairs 150, 152, and 172, 174, feed the blank 40 through station 22 to the alignment station 24.

The electric motor 180 is mounted on frame 142 and drives a sprocket 182 connected to a shaft 184, by means of a chain 186. Chain 186 is also entrained about a sprocket 188 on the drive shaft of motor 180. Motion is transmitted from motor 180 via sprocket 182 to shaft 184. Also mounted on shaft 184 is a pulley 190 and a gear 192 in mesh with a pinion 194 on a shaft 196, (FIG. 3) which also carries a second pulley 198. an endless belt 200 extends between the pulleys 190 and 198. A pulley 201 is also mounted on shaft 196 and carries a belt 155 entrained about it and the other sheave of pulley 154 connected to shaft 158.

Rotation of shaft 184 will cause rotation of shaft 196 via the pulley and belt connection 190, 198, and 200. Rotation of shaft 196 causes rotation of pulley 201, belt 155, pulley 154 and shaft 158. The meshing gears 192 and 194 control the rate of rotation of shaft 196.

Shaft 196 also mounts a pulley 202 which has an endless belt 204 entrained about it and a pulley 206 mounted on the end of shaft 88. Accordingly, rotation of shaft 196 will cause rotation of drive shaft 88 at the alignment station 24. Rotation of shaft 88 will cause endless belts 80 and 82 to move the envelope blank 40 received from the feed station 22 into engagement with pins 54 and 56 on chains 94 and 96, respectively. Sprockets 90 and 92 mounted on shaft 88 which carry the chains 94 and 96, respectively, can be connected to the shaft 88 by a suitable hub gear arrangement so that the belts 80 and 82 are driven at a faster rate than the chains 90 and 92, respectively, enabling the envelope blank to be placed in abutment with a pair of the upright pins 54 and 56 to align the blank with the remaining stations in the apparatus 20 and to space each blank from a succeeding and preceding blank.

Upon leaving the aligning station 24, the blank 40 is passed beneath the side scoring rollers 98, 100, which may be provided either singly or in pairs, as illustrated in FIG. 1A. After the side scores 58 and 60 are imprinted on blank 40, the blank is passed between the back scoring roller 106 and its compression roller 112 at station 28 and then passed to the folding section 30.

Rollers 98, 98, 112 and an additional two drive rollers 208 and 210 adjacent the path of travel of envelope blank 40 at the side scoring stations 26 and back scoring stations 28 are driven by an endless belt 212 entrained about pulleys 214 and 216 as well as pulleys connected to the shafts mounting each of the rollers 98, 98, 112, 208 and 210. Pulley 216 has an additional sheave for receiving an endless belt 218 which is entrained about a pulley 220 mounted on a shaft 222. Shaft 222 also mounts a pulley 224 which receives a belt 226 mounted on a pulley 228 connected to a driven shaft 230. Rotation of shaft 230 will drive pulleys 216 and 214 causing rotation of rollers 98, 98, 112, 208 and 210 to feed the blank 40 through the side scoring and back scoring stations 26 and 28, respectively. The roller 106, being in contact with driven roller 112 and rollers 100 being in contact with driven rollers 98 are driven by frictional contact with these rollers.

A sprocket 232 is affixed to and rotates shaft 230. Sprocket 232 is connected to an endless chain 234. Endless chain 234 is also in mesh with a sprocket 236 and a sprocket 238. Sprocket 238 is mounted on a shaft 240. a gear on shaft 240 (not shown) is in meshing engagement with a gear 242 which in turn is in meshing engagement with a gear (now shown) connected to shaft 244. Mounted on shaft 244 is a pulley 246 and a sprocket 248. Pulley 246 entrains an endless belt 250. Belt 250 is also entrained about a pulley 252 mounted on the shaft 254 of a gear reduction unit 256 connected to the output shaft of a motor (not shown). A second output shaft 258 of gear reduction unit 256 mounts a pulley 260 which entrains an endless belt 262. Endless belt 262 is also entrained about a double sheave pulley 264 mounted on a shaft 266. Double sheave pulley 264 has a belt 268 entrained about it and a pulley 270 fixed to a shaft 272. Mounted on shaft 272 is a roller 274.

Rotation of shaft 254 will cause rotation of sprocket 232 and shaft 230 via belts 250 and 234. A belt 276 mounted on a pulley on shaft 230 behind sprocket 232 is also entrained about a pulley 280 mounted on a shaft 282 connected to roller 284. An idler roller 286 maintains pressure upon belt 276 so that rotation of shaft 230 by sprocket 232 will cause belt 276 to rotate pulley 280, shaft 282 and roller 284. Roller 284 is in contact with drive roller 114 at the first folding station 30 and will drive roller 114 in a counterclockwise direction as viewed in FIG. 1A to advance the blank over idler roller 118 into abutment with roller 120.

Pulley 290 mounted on shaft 240 has an endless belt 292 entrained about it and a pulley 294 mounted on a shaft 296. Mounted on shaft 296 is a roller 298 which entrains three, parallel, endless belts 288 thereabout (see FIGS. 5 and 18). Endless belts 288 are entrained about spaced rollers 124, 126 at the opposite end of their upper runs and the belts are in frictional, tangential contact with roller 120 and drive the roller in a counterclockwise direction as viewed in FIG. 1A to advance the folded blank caught between the nip of roller 118 and roller 120 from the first folding station 30 to the gumming station 32.

Pulley 236 is affixed to a shaft 300 which carries a second pulley 302. Entrained about pulley 302 is an endless belt 304 which drives a pulley 306 mounted on a shaft 308. Shaft 308 has a gear 310 affixed to it which is in mesh with a gear 312 on shaft 136 which carries spaced gummer dies 132 and 134. Rotation of gear 312 causes rotation of shaft 136 and the gummer dies 132 and 134.

Connected to shaft 136 is a pulley 314 about which is entrained an endless belt 316 which drives a pulley 318 fixed to a shaft 320 journaled on the frame 42 of the gummer station 32. Shaft 320 mounts a transfer die 322 in contact with gummer die 132. A gear 324 is also mounted on shaft 320 which is in mesh with a pair of pinions 326 and 328. Pinion 328, in turn, is in meshing engagement with a gear 330 fixed to a shaft 332. Rotation of gear 330 causes rotation of shaft 332 which carries a gum transfer die 334 whose circumference is in contact with adhesive or gum 336 within a gum pot 338.

Figures 4, 15:
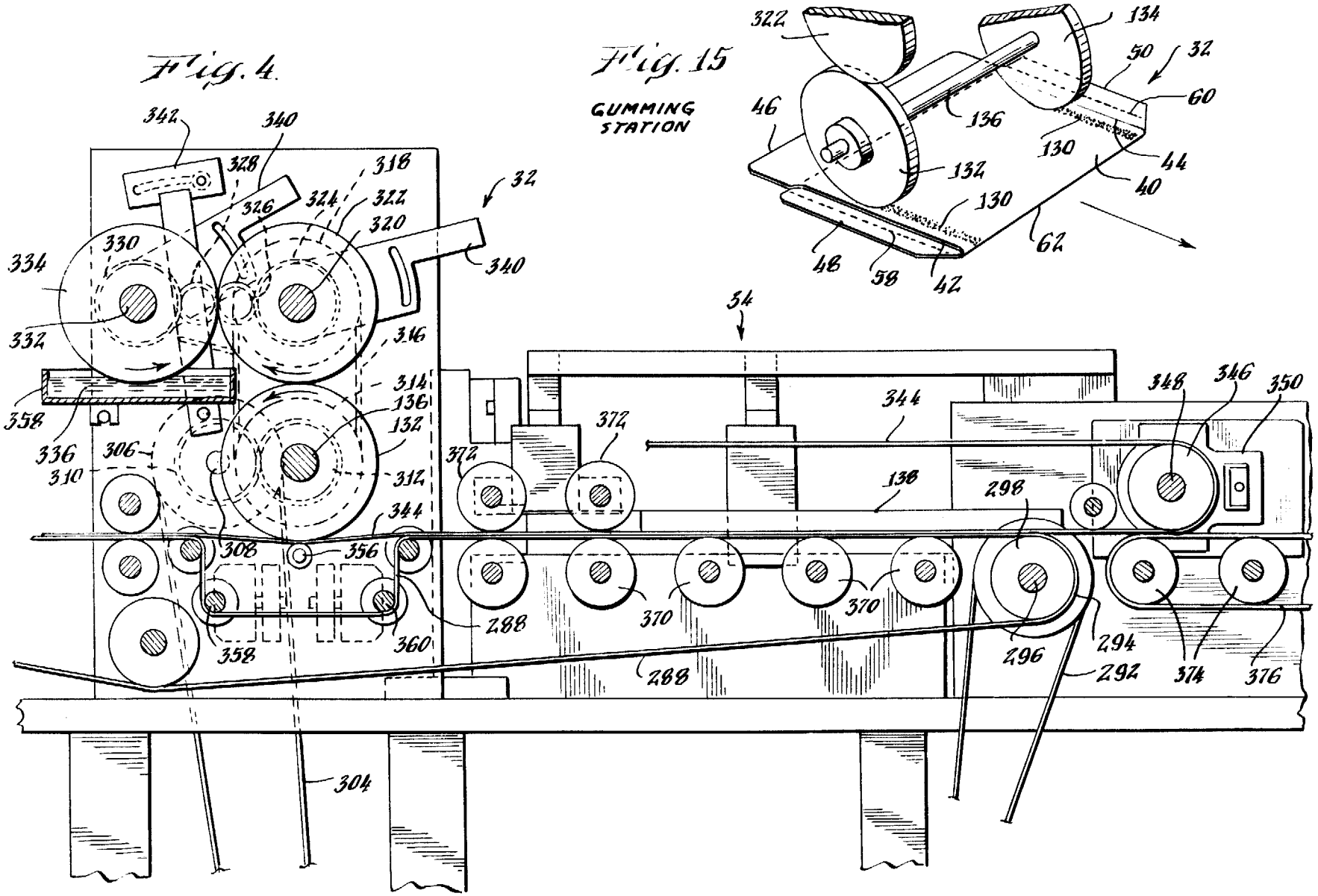
FIG. 4 is an enlarged side view in elevation of a portion of the apparatus illustrated in FIGS. 1A and 1B, and more particularly, that portion of the apparatus for applying gum to the envelope blank and folding the side edges of the blank onto the gummed portion to form an envelope enclosure.
FIG. 15 is a schematic perspective view illustrating the operation of the gumming station in the apparatus of the present invention.

As indicated in FIG. 4, rotation of pulley 300 will cause counterclockwise rotation of gumming roller 132, clockwise rotation of gum transfer roller 322 and counterclockwise rotation of gum transfer roller 334. This will cause adhesive 336 to be picked up by the circumference of die 334, transferred to the circumference of die 322 and 132 wherein it is disposed along the edges 42 and 44 of folded blank 40 as indicated in FIG. 15.

A counterweight 340 is pivotably mounted on each of the shafts 320 and 322 so that the amount of adhesive transferred from die to die can be controlled. A gum scraper 342 is also pivotably mounted to the framework 42 at station 32 for contact with the exterior surface of gum transfer dies 322 and 334 to periodically scrape the surfaces of excess gum adhered thereto.

Figure 18:
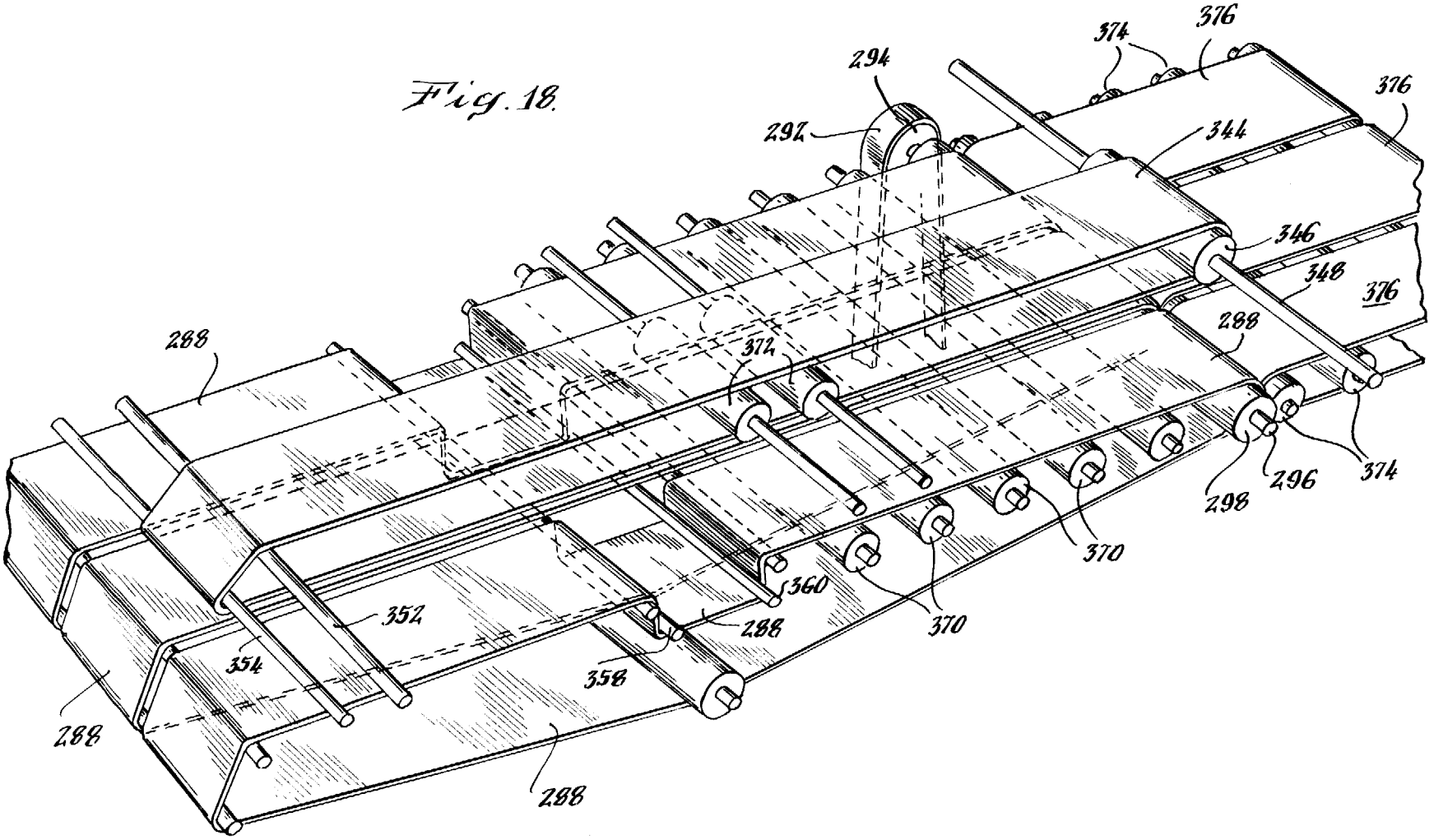
FIG. 18 is a perspective view of the downstream portion of the belt system used in the apparatus of the present invention.

As illustrated in FIGS. 1A, 4, 5 and 18, the folded envelope blank 40 enters the gum station 32 on top of spaced belts 288 driven by pulley 294 and roller 298 on shaft 296. A top belt 344 of narrower width than the combined width of the three belts 288 is entrained about a pulley 346 driven by a shaft 348 connected to a driven pulley 350 which can be connected to a suitable drive motor (not shown) or driven by a suitable pulley and belt drive connection mounted on shaft 296. At its opposite end, belt 344 is entrained about idler rollers 352 and 354. Belt 344 aids in frictionally holding the center portion of the blank to the lower belts 288 and frictionally retains the blank against an idler roller 356 at the gumming station 32 because the outer two belts 288 are looped away from the dies 132 and 134 beneath rollers 358 and 360 as shown in FIGS. 4 and 18. The loop beneath the dies 132 and 134 of the outer two belts 288 is designed to preclude gum or adhesive from contacting the belts 288 between spaced blanks 40. The top belt 344 continues to frictionally drive the blank through gum station 32 as the gum is applied to it.

Figure 5:
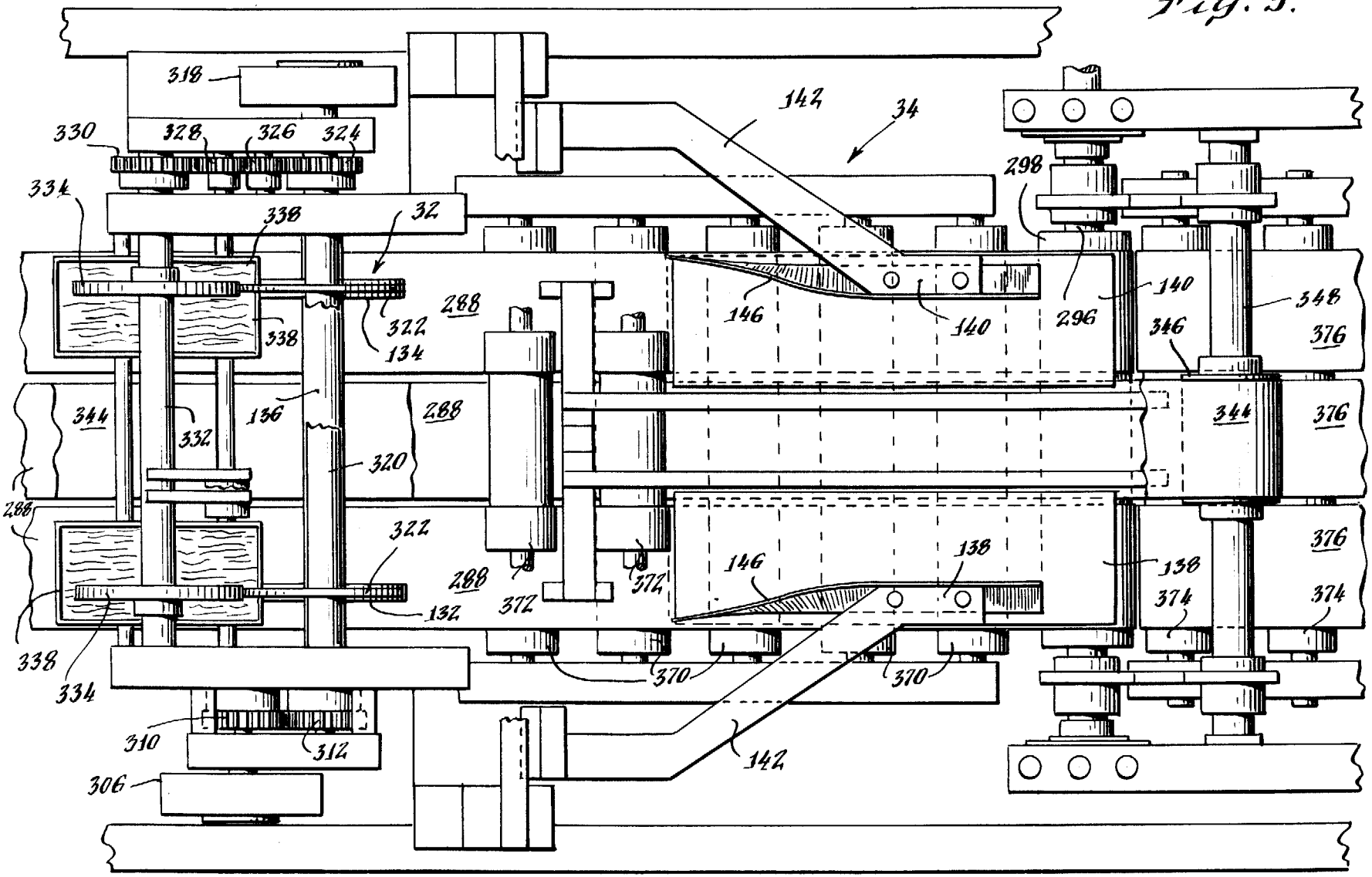
FIG. 5 is a top plan view of the apparatus in FIG. 4.
Figure 7:
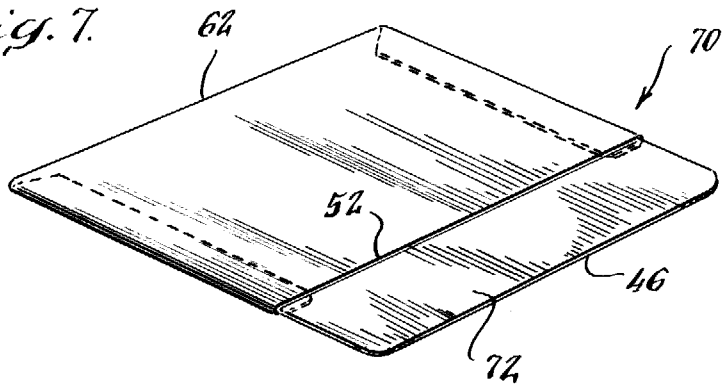
FIG. 7 is a perspective view of the floppy disc envelope formed by the apparatus of the present invention.

After leaving the gumming station 32, the blank is passed to the second folding station 34 (see FIGS. 1B, 4 and 5). The opposite edges 48 and 50 of blank 40 are turned in folders 138 and 140, respectively, back upon themselves and adhered to the upper half of the folded bland as illustrated in FIGS. 16 and 17. Idler rollers 370 and 372 below and above belts 288, respectively, aid in supporting the belts 288 and blank 40 as the blank moves through the station into the folders 138 and 140.

The completed envelope 70 exits from the folders 138, 140 onto a final drive conveyor 376 which can comprise three endless belts contiguous to belts 288, supported by rollers 374. The conveyor 376 is driven by a pulley 378 fixed to a shaft 380. Rotating the pulley is an endless belt 382 entrained about a pulley 384 fixed to a shaft 386. A sprocket 388 drives shaft 386 and is connected to an endless chain 390 carried by sprocket 248 driven by shaft 244.

As indicated in FIG. 1B, the completed envelope 70 is dropped onto an endless belt 36 and conveyed to table 38. Endless belt 36 is supported by rollers 392 and 394. Roller 392 is mounted on a shaft 396 having a pulley 398 affixed thereto. Entrained about pulley 398 is an endless belt 400 mounted on a pulley 402 affixed to a shaft 404 of a driving motor 406. Rotation of motor 406 will therefore cause rotation of roller 392 and travel of endless belt 36 in the direction indicated in FIG. 1B.

An endless belt 408 entrained about rollers 410 and 412, one of which is driven, is provided above belt 36 to maintain pressure on the envelopes 70 as they travel along the belt to table 38.

What is claimed as new is:

1. In an apparatus for manufacturing envelopes from substantially planar envelope blanks having a leading and trailing edge connected by a pair of spaced side edges, said apparatus including successively, a first and second scoring station, a first folding station, a gum applying station, and a second folding station:

means for feeding said blanks in tandem to said stations including at least one upper and lower blank contacting belt for supporting and feeding each blank through said gum applying and second folding stations, means for spacing said blanks from each other and aligning the blanks with said stations, means at said first scoring station for scoring the blanks along line spaced from but parallel to the side edges thereof, means at said second scoring station for scoring the blanks substantially perpendicular to the first score lines intermediate the leading and the trailing edges of each blank, means at said first folding station for folding said blanks substantially in half about said intermediate score line so that the leading edge of each blank overlaps the trailing edge thereof to form a lower and upper folded half, means at said gum applying station including a pair of spaced gum applying dies in the feed path of each of said blanks for transferring gum from a gum pot to said blanks along spaced areas adjacent the longitudinal edges of the upper half of each of said folded blanks, said lower belt having adjacent portions spaced substantially below said gum applying dies and the feed path of each blank at said gum applying station so as not to contact said dies between successive blanks, means at said second folding station disposed in the path of movement of said blanks for folding the opposite longitudinal edges on said lower half of each of said blanks 180 degrees about an adjacent score line to overlie a gummed area on the upper half of said blank, and means for conveying said folded and gummed blanks to a collection point.

2. In an apparatus for manufacturing envelopes from substantially planar ungummed envelope blanks having a leading and trailing edge connected by a pair of spaced side edges, said apparatus including successively, a first and second scoring station, a first folding station, a gum applying station, and a second folding station:

means for feeding said ungummed blanks in tandem to said stations, means for spacing said ungummed blanks from each other and aligning the blanks with said stations, means at said first scoring station for scoring the ungummed blanks along lines spaced from but parallel to the side edges thereof, means at said second scoring station for scoring the ungummed blanks substantially perpendicular to the first score lines intermediate the leading and the trailing edges of each blank, means at said first folding station for folding said blanks substantially in half about said intermediate score line so that the leading edge of each blank overlaps the trailing edge thereof to form a lower and upper folded half, means at said gum applying station for transferring gum from a gum pot to said previously ungummed blanks along spaced areas adjacent the longitudinal edges of the upper half of each of said folded blanks, means at said second folding station disposed in the path of movement of said blanks for folding the opposite longitudinal edges on said lower half of each of said blanks 180 degrees about an adjacent score line to overly a gummed area on the upper half of said blank, and means for conveying said folded and gummed blanks to a collection point.

3. Apparatus in accordance with claim 2 wherein said first scoring means includes a pair of spaced crease imprint rollers.

4. Apparatus in accordance with claim 2 wherein said aligning means includes a pair of endless belts, an endless chain adjacent each of said endless belts, each of said chains including a plurality of upright fingers spaced along said belt for abutment with said blank, and means for driving said belts at a greater speed than said chains.

5. Apparatus in accordance with claim 2 wherein said first folding means includes a first driven roller for advancing each blank, a second driven roller adjacent said first driven roller, and an idler roller between said first and second rollers forming a nip with said second roller, whereby each of said blanks are advanced by said first driven roller over said idler roller into rolling abutment with said second driven roller, and means operatively connected to said second roller for driving the roller in the same direction as said first roller so that when the intermediate score line on each blank is adjacent the nip between said idler roller and said second roller, the blank adjacent said score line is pulled through the nip between said idler roller and second roller to cause the blank to bend back upon itself.

6. Apparatus in accordance with claim 2 wherein said gum transferring means includes a pair of spaced gum applying dies in the feed path of each of said blanks.

7. Apparatus in accordance with claim 6 further including a plurality of gum transfer dies between said gum pot and gum applying dies.

8. Apparatus in accordance with claim 6 further including means at said gum applying station for varying said gum strip applied to each blank by said gum transfer dies.

9. Apparatus in accordance with claim 7 further including means at said gum applying station for scraping excess gum from said gum applying dies.

10. Apparatus in accordance with claim 6 wherein said feed means includes at least one upper and lower blank contacting belt for supporting and feeding each blank through said gum applying and second folding stations.

11. Apparatus in accordance with claim 4 wherein said second scoring means includes a roller having a radially extending scoring fin on its exterior surface.

12. Apparatus in accordance with claim 2 wherein said second folding means includes a folder having an arcuate contact surface in the path of movement of each of the longitudinal side edges of the lower half of each folded blank.

13. Apparatus in accordance with claim 4 wherein said first scoring means includes a pair of spaced crease imprint rollers.

14. Apparatus in accordance with claim 13 wherein said second scoring means includes a roller having a radially extending scoring fin on its exerior surface.

15. Apparatus in accordance with claim 14 wherein said first folding means includes a first driven roller for advancing each blank, a second driven roller adjacent said first driven roller, and an idler roller between said first and second rollers forming a nip with said second roller, whereby each of said blanks are advanced by said first driven roller over said idler roller into rolling abutment with said second driven roller, and means operatively connected to said second roller for driving the roller in the same direction as said first roller so that when the intermediate score line on each blank is adjacent the nip between said idler roller and said second roller, the blank adjacent said score line is pulled through the nip between said idler roller and second roller to cause the blank to bend back upon itself.

16. Apparatus in accordance with claim 15 wherein said gum transferring means includes a pair of spaced gum applying dies in the feed path of each of said blanks.

17. In an apparatus for manufacturing envelopes from substantially planar envelope blanks having a leading and trailing edge connected by a pair of spaced side edges, said apparatus including successively, a first and second scoring station, a first folding station, a gum applying station, and a second folding station:

means for feeding said blanks in tandem to said stations including at least one upper and lower blank contacting belt for supporting and feeding each blank through said gum applying and second folding stations, means for spacing said blanks from each other and aligning the blanks with said stations including a pair of endless belts, an endless chain adjacent each of said endless belts, each of said chains including a plurality of upright fingers spaced along said belt for abutment with said blank, and means for driving said belts at a greater speed than said chains, means at said first scoring station for scoring the blanks along lines spaced from but parallel to the side edges thereof, including a pair of spaced crease imprint rollers, means at said second scoring station for scoring the blanks substantially perpendicular to the first score lines intermediate the leading and the trailing edges of each blank including a roller having a radially extending scoring fin from its exterior surface, means at said first folding station including a pair of spaced gum applying dies in the feed path of both of said blanks for folding said blanks substantially in half about said intermediate score line so that the leading edge of each blank overlaps the trailing edge thereof to form a lower and upper folded half, said first folding means including a first driven roller for advancing each blank, a second driven roller adjacent said first driven roller, and an idler roller between said first and second rollers forming a nip with said second roller, whereby each of said blanks are advanced by said first driven roller over said idler roller into rolling abutment with said second driven roller, and means operatively connected to said second roller for driving the roller in the same direction as said first roller so that when the intermediate score line on each blank is adjacent the nip between said idler roller and said second roller, the blank adjacent said score line is pulled through the nip between said idler roller and second roller to cause the blank to bend back upon itself, means at said gum applying station for transferring gum from a gum pot to said blanks along spaced areas adjacent the longitudinal edges of the upper half of each of said folded blanks, means at said second folding station disposed in the path of movement of said blanks for folding the opposite longitudinal edges on said lower half of each of said blanks 180 degrees about an adjacent score line to overlie a gummed area on the upper half of said blank, and means for conveying said folded and gummed blanks to a collection point.

18. Apparatus in accordance with claim 17 wherein said lower belt has adjacent portions spaced substantially below said gum applying dies and the feed path of each blank at said gum applying station so as not to contact said dies between successive blanks.

19. Apparatus in accordance with claim 18 further including means at said gum applying station for varying said gum strip applied to each blank by said gum transfer dies.

20. Apparatus in accordance with claim 18 further including means at said gum applying station for scraping excess gum from said gum applying dies.

* * * * *